US009752825B2

(12) United States Patent
Bauer

(10) Patent No.: US 9,752,825 B2
(45) Date of Patent: Sep. 5, 2017

(54) LIQUEFACTION OF A HYDROCARBON-RICH FRACTION

(71) Applicant: Heinz Bauer, Ebenhausen (DE)

(72) Inventor: Heinz Bauer, Ebenhausen (DE)

(73) Assignee: Linde Aktiengesellschaft, Munich (DE)

( * ) Notice: Subject to any disclaimer, the term of this patent is extended or adjusted under 35 U.S.C. 154(b) by 173 days.

(21) Appl. No.: 14/689,322

(22) Filed: Apr. 17, 2015

(65) Prior Publication Data

US 2015/0308734 A1 Oct. 29, 2015

(30) Foreign Application Priority Data

Apr. 24, 2014 (DE) ..... 10 2014 005 936

(51) Int. Cl.
*F25J 1/00* (2006.01)
*F25J 1/02* (2006.01)

(52) U.S. Cl.
CPC ..... *F25J 1/0022* (2013.01); *F25J 1/005* (2013.01); *F25J 1/0055* (2013.01); *F25J 1/0072* (2013.01); *F25J 1/0204* (2013.01); *F25J 1/0212* (2013.01); *F25J 1/0248* (2013.01); *F25J 1/0256* (2013.01); *F25J 1/0258* (2013.01); *F25J 1/0262* (2013.01); *F25J 2205/20* (2013.01); *F25J 2220/60* (2013.01); *F25J 2220/64* (2013.01); *F25J 2245/42* (2013.01); *F25J 2270/16* (2013.01); *F25J 2290/34* (2013.01)

(58) Field of Classification Search
CPC ..... F25J 1/0022; F25J 1/0244; F25J 1/0245; F25J 1/0249; F25J 2280/20; F25J 2280/40
See application file for complete search history.

(56) References Cited

U.S. PATENT DOCUMENTS 3,282,059 A * 11/1966 Maher ..... F25J 1/0022 62/613
2009/0217701 A1* 9/2009 Minta ..... F25J 1/0022 62/612
2012/0000242 A1* 1/2012 Baudat ..... F25J 1/0022 62/614
2012/0090350 A1* 4/2012 Mak ..... F25J 1/0022 62/613

FOREIGN PATENT DOCUMENTS

JP 2004324761 A * 11/2004

OTHER PUBLICATIONS

JP 2004324761 A Translation.*

* cited by examiner

*Primary Examiner* — Frantz Jules
*Assistant Examiner* — Brian King
(74) *Attorney, Agent, or Firm* — Philip H. Von Neida

(57) ABSTRACT

A process for liquefying and subcooling a hydrocarbon-rich fraction, particularly natural gas, is described wherein, once cooled down, the fraction is subjected to a partial condensation to remove heavy hydrocarbons, particularly benzene, by the steps of: a) the liquefied hydrocarbon-rich fraction is subcooled in a separate heat exchanger (normal mode), b) the supply of the liquefied hydrocarbon-rich fraction to the heat exchanger is interrupted at the latest when a defined solid deposition value in the heat exchanger is reached (cleaning mode), c) the solid in the heat exchanger is melted with a defrost gas and drawn off from the heat exchanger and d) the liquefied hydrocarbon-rich fraction is subsequently returned to the heat exchanger.

8 Claims, 2 Drawing Sheets

LIQUEFACTION OF A HYDROCARBON-RICH FRACTION

CROSS REFERENCE TO RELATED APPLICATIONS

This application claims priority from German Patent Application DE 102014005936.7 filed on Apr. 24, 2014.

BACKGROUND OF THE INVENTION

The invention relates to a process for liquefying and subcooling a hydrocarbon-rich fraction, particularly of natural gas, wherein, once cooled down, the fraction is subjected to a partial condensation to remove heavy hydrocarbons, particularly benzene.

Liquefaction and subcooling of a hydrocarbon-rich fraction is typically achieved against at least one refrigerant cycle and/or at least one mixed refrigerant cycle.

Preventing outages caused by freezing-out of certain components of the fraction to be liquefied is of great importance in the liquefaction of hydrocarbon-rich fractions, particularly natural gas. Water and carbon dioxide are typically removed at the beginning of the process at ambient temperature by chemical scrubbing (e.g. amine scrubbing) and/or adsorptive processes to such an extent that they do not cause undesired solid formation during liquefaction of the hydrocarbon-rich fraction.

Freezing-prone heavy hydrocarbons (HH) (hereinbelow the term "heavy hydrocarbons" is to encompass $C_{6+}$ hydrocarbons), benzene in particular, can be removed under ambient conditions from the fraction to be liquefied only at great cost and inconvenience. Hence it is common practice to subject the feed gas to a slight partial condensation and then draw off an HH-rich liquid fraction in a separator to sufficiently reduce the risk that the gas phase exiting this separator will freeze during subsequent liquefaction and subcooling.

However, partial condensation generally only ensures that the gas phase is sufficiently depleted in HHs, particularly benzene, when the gas mixture to be liquefied comprises components having a middle boiling range, for example propane, butane and/or pentane, which during cooling-down of the feed gas undergo liquefaction in sufficient amounts before the HHs and thus act as solvent for said HHs.

When an insufficient concentration of middle boilers—this is referred to as so-called lean gas—in the composition of the feed gas does not allow sufficient depletion in benzene (typically to <1 ppmv) by partial condensation and subsequent removal of the HH-rich liquid, unwanted freezing-out can still occur.

It is an object of the present invention to specify a process of the type in question for liquefying and subcooling a hydrocarbon-rich fraction, particularly of natural gas, which achieves reliable and economical removal of heavy hydrocarbons even under these conditions.

SUMMARY OF THE INVENTION

This object is achieved by a process for liquefying and subcooling a hydrocarbon-rich fraction, particularly natural gas, said process being characterized in that a) the liquefied hydrocarbon-rich fraction is subcooled in a separate heat exchanger (normal mode), b) the supply of the liquefied hydrocarbon-rich fraction to the heat exchanger is interrupted at the latest when a defined solid deposition value in the heat exchanger is reached (cleaning mode), c) the solid in the heat exchanger is melted with a defrost gas and drawn off from the heat exchanger and d) the liquefied hydrocarbon-rich fraction is subsequently returned to the heat exchanger.

According to the invention, the already liquefied hydrocarbon-rich fraction is now subcooled in a separate heat exchanger (subcooler) in which freezing-out or deposition of solid is deliberately permitted. The process thus intentionally seeks to achieve solid formation of the heavy hydrocarbons at a temperature of below −70° C., preferably below −80° C., in the subcooler in the liquefaction of natural gas. When a defined solid deposition value in this separate heat exchanger has been reached, normal mode is interrupted and the process switches to cleaning mode. To achieve this, the supply to the subcooler of the liquefied hydrocarbon-rich fraction to be subcooled is interrupted and the liquefied fraction is immediately sent for further use and/or to intermediate storage. The aforementioned defined solid deposition value may, for example, be determined by an increased pressure drop of the hydrocarbon-rich fraction to be subcooled during passage through the subcooler. According to the invention, cleaning mode comprises melting the solid using a suitable amount of defrost gas at a suitable temperature and subsequently drawing off the resulting melt from the separate heat exchanger at a suitable point, preferably at a/the conduit low point(s), and in concentrated form and generally sending said melted solid outside the plant boundary. The amount and/or temperature of the defrost gas are to be chosen such that at least 50%, preferably at least 70%, of the amount of solid can be melted and removed. A development of the process according to the invention proposes that once the solid in the separate heat exchanger has been melted at least the heat exchanger passages of the separate heat exchanger in which solid formation can occur are purged with a gaseous or liquid purging medium. This purging melts and removes remaining solids in the separate heat exchanger. Particularly suitable purging media are dry nitrogen and a boil-off gas fraction generated during intermediate storage of the liquefied and subcooled hydrocarbon-rich fraction.

After cleaning, the supply of the defrost gas and/or the purging medium is terminated and the process switches to normal mode by returning the liquefied hydrocarbon-rich fraction to be subcooled to the separate heat exchanger.

When, in normal mode, the liquefied hydrocarbon-rich fraction is subcooled in a separate heat exchanger against at least one refrigerant stream and/or at least one mixed refrigerant stream, one advantageous embodiment of the process according to the invention for liquefying and subcooling a hydrocarbon-rich fraction is characterized in that in cleaning mode this refrigerant stream and/or mixed refrigerant stream are used to cool the hydrocarbon-rich fraction to be liquefied.

Owing to the above-described rerouting of the refrigerant stream and/or mixed refrigerant stream in cleaning mode, the heat exchanger or heat exchanger zone disposed upstream of the separate heat exchanger assumes, at least to an extent, the subcooling function of the separate heat exchanger. This regime efficaciously avoids the situation where the liquefied hydrocarbon-rich fraction exiting the liquefaction zone in cleaning mode is distinctly warmer than the subcooled fraction exiting the separate heat exchanger in normal mode. Hence even in cleaning mode the liquefied hydrocarbon-rich fraction drawn off at the cold end of the process is at a temperature no more than 30° C., preferably no more than 20° C., higher than the temperature of the subcooled hydrocarbon-rich fraction in normal mode.

When the hydrocarbon-rich fraction to be liquefied is liquefied and subcooled against at least one refrigeration cycle, a further advantageous embodiment of the process according to the invention provides that the defrost gas required for cleaning mode is a substream of the refrigerant circulating in the refrigeration cycle. When this refrigeration cycle comprises, for example, a two-stage compressor unit, the refrigerant substream serving as defrost gas may be drawn off from the suction side of the second compressor stage, expanded to a suitable pressure and optionally heated, passed through the separate heat exchanger and subsequently sent to the suction side of the first compressor stage.

BRIEF DESCRIPTION OF THE DRAWINGS

The process according to the invention for liquefying and subcooling a hydrocarbon-rich fraction and also further advantageous embodiments thereof are more particularly elucidated hereinbelow with reference to the working examples shown in FIGS. 1 and 2.

DETAILED DESCRIPTION OF THE INVENTION

Figure 1:
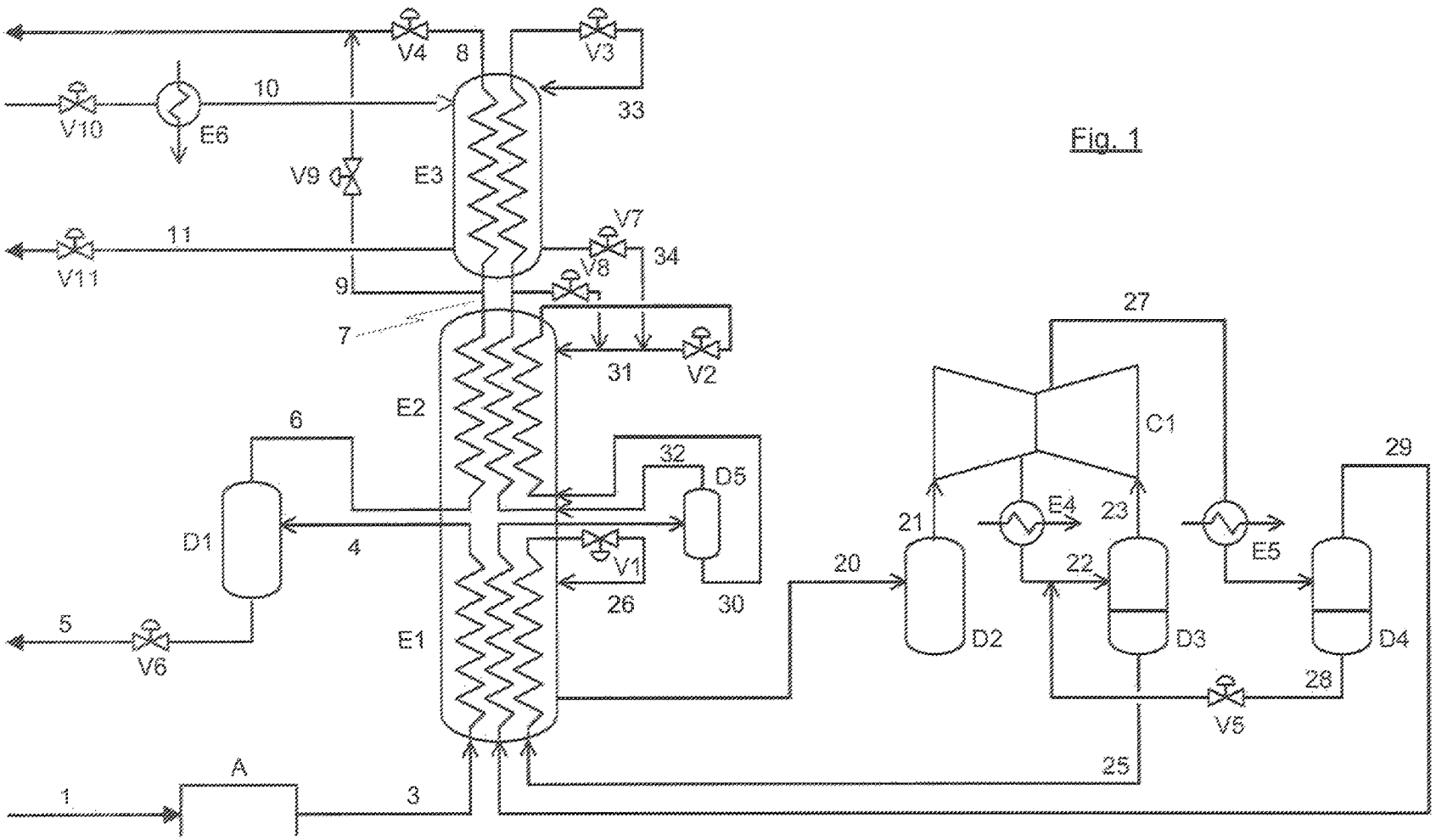
FIG. 1 shows a regime where the hydrocarbon-rich fraction is liquefied and subcooled against a mixed cycle while the regime shown in FIG. 2 employs a two-stage nitrogen expander cycle.

Hydrocarbon-rich feed fraction 1 to be liquefied, for example so-called lean natural gas, is sent, prior to actual liquefaction, to removal unit A in which a chemical scrub and/or an adsorptive process are used to remove water and carbon dioxide which are drawn off via line 2. The thus prepurified feed fraction 3 is sent to first heat exchanger or heat exchanger zone E1 in which it is cooled down and partially condensed. Partially condensed fraction 4 is then sent to separator D1 and separated into heavy hydrocarbons-containing liquid fraction 5 and hydrocarbon-rich gas fraction 6. While the former is drawn off from the bottom of separator D1 via control valve V6, gaseous fraction 6 is liquefied in second heat exchanger or heat exchanger zone E2. According to the invention, liquefied hydrocarbon-rich fraction 7 is subcooled in separate heat exchanger or subcooler E3. Subcooled hydrocarbon-rich fraction 8—in the case of natural gas the LNG product fraction—is sent for further use and/or intermediate storage via valve V4. Heat exchangers E1 to E3 described above may be helically coiled heat exchangers and/or welded plate exchangers.

In the regime shown in FIG. 1, cooling-down, liquefaction and subcooling of the hydrocarbon-rich fraction are achieved against a mixed cycle comprising two-stage compressor unit C1. The refrigerant vaporized and warmed in heat exchangers E1 to E3 is sent via line 20 to vessel D2 disposed upstream of the first stage of compressor unit C1. Gas fraction 21 accumulating in said vessel is compressed to an intermediate pressure in the first compressor stage of compressor unit C1, cooled down and partially condensed in intermediate cooler E4 and sent via line 22 to second separator D3. Gas fraction 23 accumulating in said second separator is compressed to the desired final cycle pressure in the second compressor stage of compressor unit C1 and sent to third separator D4 via line 27 in which aftercooler E5 is disposed.

Liquid fraction 25 drawn off from the bottom of second separator D3 is cooled down in heat exchanger E1. This fraction is subsequently subjected to refrigerating expansion in valve V1 and passed, countercurrently to hydrocarbon-rich feed fraction 3 to be cooled down, through heat exchanger E1 via line 26. While liquid fraction 28 accumulating in third separator D4 is recycled to a point upstream of second separator D3 via control valve V5, gas fraction 29 accumulating in third separator D4 is likewise cooled down and partially condensed in heat exchanger E1 and then separated into liquid fraction 30 and gas fraction 32 in separator D5.

The latter is condensed and subcooled in heat exchangers E2 and E3, subjected to refrigerating expansion in valve V3 and is passed via line 33 through separate heat exchanger E3 to provide the peak refrigeration required therein. This fraction is subsequently admixed via control valve V7 and line 34 with liquid fraction 30 cooled down in heat exchanger E2. Said liquid fraction is subjected to refrigerating expansion in expansion valve V2 and subsequently passed, countercurrently to hydrocarbon-rich feed fraction ⅜ which is to be cooled down and liquefied, through heat exchangers E2 and E3 via line 31.

According to the invention, heat exchanger or subcooler E3 is a discrete apparatus. Said apparatus is connected to heat exchangers E1 and E2 only via conduits. Now, when a defined solid deposition value in heat exchanger E3 is reached, the process switches from normal mode to cleaning mode. This is achieved by closing valve V4 and opening valve V9, so liquefied hydrocarbon-rich fraction 7 bypasses heat exchanger E3 via line 9. In a simultaneous operation valves V3 and V7 are closed and valve V8 is opened, so gas fraction 32 drawn off from separator D5 is now passed exclusively through heat exchanger E2. Due to this rerouting of refrigerant fraction 32, heat exchanger E2 assumes, at least to an extent, the subcooling of the liquefied hydrocarbon-rich fraction which in normal mode is effected in separate heat exchanger E3.

Simultaneously with the above-described opening and closing of valves V3, V4 and V7 to V9, and with valves V10 and V11 open, a suitable amount of defrost gas at a suitable temperature is passed via line 10 through heat exchanger E3 and drawn off via line 11. Heat exchanger E6 provided in line 10 heats this defrost gas. Now, rather than refrigerant fraction 32 which flows through heat exchanger E3 in normal mode, defrost gas 10 serves as heat-transfer medium and melts the solids deposited in heat exchanger E. Said solids can be drawn off in concentrated form at a suitable point between heat exchangers E2 and E3, for example at the conduit low points, via appropriate shutoff valves which, for clarity, are not shown.

Figure 2:
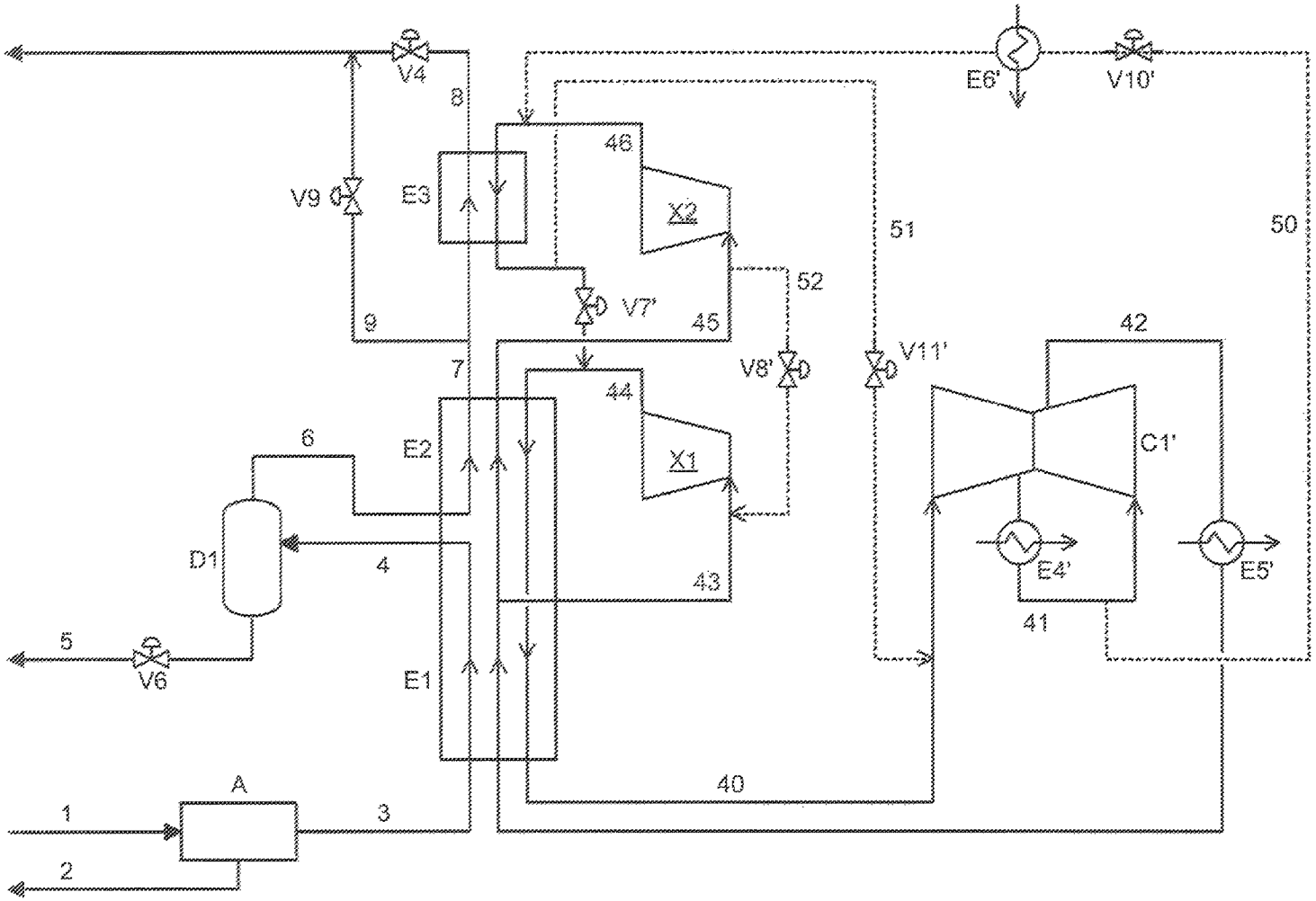

In the regime shown in FIG. 2, cooling-down, liquefaction and subcooling of the hydrocarbon-rich feed fraction are achieved via a two-stage nitrogen expander cycle. Since the regime for the hydrocarbon-rich feed fraction to be liquefied and subcooled here is identical to that of FIG. 1, it will not be discussed further in what follows; hence what follows describes only the nitrogen expander cycle.

Nitrogen-rich refrigerant 40 warmed in heat exchangers E1 to E3 is compressed to an intermediate pressure in the first compressor stage of compressor unit C1', cooled down in intermediate cooler E4' and sent via line 41 to the second compressor stage of compressor unit C1'. Refrigerant 42 compressed to the cycle end pressure is cooled down in aftercooler E5° and cooled down in heat exchangers E1 and E2. A first substream 43 of the cooled-down refrigerant is sent to a first expander X1, subjected to refrigerating and work-performing expansion therein and passed, countercurrently to hydrocarbon-rich feed fraction 3 which is to be liquefied, through heat exchangers E2 and E1 via line 44. The second refrigerant substream 45 is sent to second expander X2 to likewise undergo refrigerating and work-performing expansion, passed, countercurrently to the hydrocarbon-rich fraction 7 which is to be subcooled, through separate heat exchanger E3 via line 46 and subsequently admixed via valve V' with the above-described refrigerant substream 44.

When the defined solid deposition value in heat exchanger X3 is reached, second expander X2 is taken off stream. In a simultaneous operation valve V7' is closed and valves V8', V10' and V11' are opened. With valve V8' open, second refrigerant substream 45, hitherto sent to second expander X2, is now sent via line 52, shown dashed in the figure, to a point upstream of first expander X1. With valve V10' open—said valve is used for adjustment of the desired defrost gas pressure—a substream of the refrigerant drawn off upstream of the second compressor stage is sent as defrost gas to heat exchanger E3 via line 50 shown with a dotted line in the figure. Heat exchanger E6' is used for any defrost gas heating required. Having passed through heat exchanger E3, and with valve V11' open, the defrost gas is recycled via line 51, shown with a dotted line in the figure, to a point upstream of the first compressor stage of compressor unit C1'.

The process according to the invention for liquefying and subcooling a hydrocarbon-rich fraction, particularly of natural gas, achieves reliable and economical removal of heavy hydrocarbons, particularly of benzene, even when a so-called lean gas is used. The implementation of the concept according to the invention is independent of the chosen type of liquefaction and subcooling of the hydrocarbon-rich fraction.

What I claim is:

1. A process for liquefying and subcooling a hydrocarbon-rich fraction comprising:

a) providing a flow of a hydrogen-rich fraction;

b) cooling the hydrogen-rich fraction in a first heat exchanger to form a partially condensed fraction;

c) separating the partially condensed fraction to form a heavy hydrocarbons-containing liquid fraction and a hydrocarbon-rich gas fraction;

d) liquefying the hydrocarbon-rich gas fraction in a further heat exchanger to form a liquefied hydrocarbon-rich fraction;

wherein the method further comprises operating a separate heat exchanger comprising:

e) operating in a normal mode comprising e1) the liquefied hydrocarbon-rich fraction in the separate heat exchanger to produce a subcooled hydrocarbon-rich fraction;

e2) monitoring an amount of solid deposition formed in the separate heat exchanger;

f) when the amount of solid deposition reaches a defined value, operating in a cleaning mode which comprises;

f1) interrupting the supply of the liquefied hydrocarbon-rich fraction to the separate heat exchanger at the latest when the amount of solid deposition value in the separate heat exchanger reaches a defined value, such that the separate heat exchanger switches to the cleaning mode;

f2) feeding a defrost gas into the the separate heat exchanger so that the solid deposition is melted to form a melted deposition;

f3) drawing off the melted deposition from the separate heat exchanger and g) subsequently returning to operating the separate heat exchanger in the normal mode in which the liquefied hydrocarbon-rich fraction is returned to the separate heat exchanger to be subcooled.

2. The process according to claim 1, wherein the hydrocarbon-rich fraction is natural gas.

3. The process according to claim 1, wherein the heavy hydrocarbon is benzene.

4. The process according to claim 1, wherein in step e) in the normal mode, the liquefied hydrocarbon-rich fraction is subcooled in the heat exchanger against at least one refrigerant stream and/or at least one mixed refrigerant stream, and in step f) in the cleaning mode said refrigerant stream and/or mixed refrigerant stream are also used to cool the hydrocarbon-rich fraction in the first and/or second heat exchangers.

5. The process according to claim 1, wherein in steps b) and d) the hydrocarbon-rich fraction is liquefied and subcooled against at least one refrigeration cycle having a refrigerant, wherein a substream of the refrigerant is the defrost gas.

6. The process according to claim 1 wherein the cleaning mode of step e) further includes after the solid deposition in the heat exchanger has been melted purging passages of the heat exchanger in which the solid deposition occurs.

7. The process according to claim 4, wherein the liquefied and subcooled hydrocarbon-rich fraction is sent to an intermediate storage; and the passages of the heat exchanger are purged by a supply of dry nitrogen and/or a boil-off gas fraction generated during the intermediate storage of the liquefied and subcooled hydrocarbon-rich fraction.

8. The process according to claim 1, wherein cooling-down, liquefaction and subcooling of the hydrocarbon-rich fraction is carried out in helically coiled heat exchangers and/or welded plate exchangers.

* * * * *